US005474201A

United States Patent [19]

Liu

[11] Patent Number: 5,474,201

[45] Date of Patent: Dec. 12, 1995

[54] STRUCTURE OF A FOOT TRASH CAN

[76] Inventor: Chin C. Liu, No. 25, Lane 16, Tung Hsing St., Shu Lin Town, Taipei, Hsien, Taiwan

[21] Appl. No.: 324,089

[22] Filed: Oct. 14, 1994

[51] Int. Cl.[6] ..... B65D 90/04

[52] U.S. Cl. ..... 220/410; 220/264; 220/23.83; 220/23.86; 220/331; 220/769; 220/770; 220/773; 220/908

[58] Field of Search ..... 220/262, 263, 220/264, 408, 410, 23.83, 23.86, 331, 336, 766, 769, 770, 773, 775, 776, 908

[56] References Cited

U.S. PATENT DOCUMENTS

| | | | |
|---|---|---|---|
| 3,067,986 | 12/1962 | Grantham | 220/264 X |
| 3,995,764 | 12/1976 | Zagami | 220/331 X |
| 5,170,904 | 12/1992 | Neuhaus | 220/264 X |
| 5,322,179 | 6/1994 | Ting | 220/407 |

*Primary Examiner*—Allan N. Shoap
*Assistant Examiner*—Stephen Cronin
*Attorney, Agent, or Firm*—Pro-Techtor International

[57] ABSTRACT

A structure of a foot trash can is to improve the disadvantages of a conventional foot trash can which lifts up its cover vertically right above the opening of the can and easily spreads bad odor out of the trash can; the user can use his toes to press down a pedal and the pedal will push a coupling lever upward to make a rod support rotate to move the cover slidingly downward along the slope opening of the can main body to its back side so as to make the can widely open, in this way there is no air current formed and no bad odor spreaded out of the can; the opening of the can is designed to have a slope flange so that the cover may easily slide downward and make the opening of the can expose itself completely for users to throw trash easily; this can improve the disadvantage of the conventional foot trash can.

1 Claim, 6 Drawing Sheets

STRUCTURE OF A FOOT TRASH CAN

BACKGROUND OF THE INVENTION

1. Field of the Invention

This invention relates to a new structure of a foot trash can, particularly a new design of trash can which has a cover easily controlled by the user's foot to open completely by sliding to one side.

2. Description of the Prior Art

Now referring to FIG. 1, the motion of the conventional trash can is made by pushing down the foot control lever to move the cover of the can to a nearly vertical position and make the can cover widely open; however, in this way of opening the cover, it is easy to form an air current around the opening of the can to draw odor out of the can and disperse it in the air, just like a fan drawing stingy odor out of the can and spread it to the user to disgust him and make him unhappy. Besides, when the cover is vertically opened, it will prevent other users from throwing trash into the can from the opposite position. The object of the present invention is to overcome these disadvantages of a conventional trash can.

SUMMARY OF THE INVENTION

The object of the present invention is to provide a new structure of a foot trash can which can be easily controlled by the user's foot to open its cover, and the can main body can be designed in various kinds of shape. Particularly, its cover is designed to open by sliding to one side so that its opening can be completely exposed to the users and convenient for them to throw trash into it from all directions and that there will not be any air current formed to draw bad odor out of the can.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
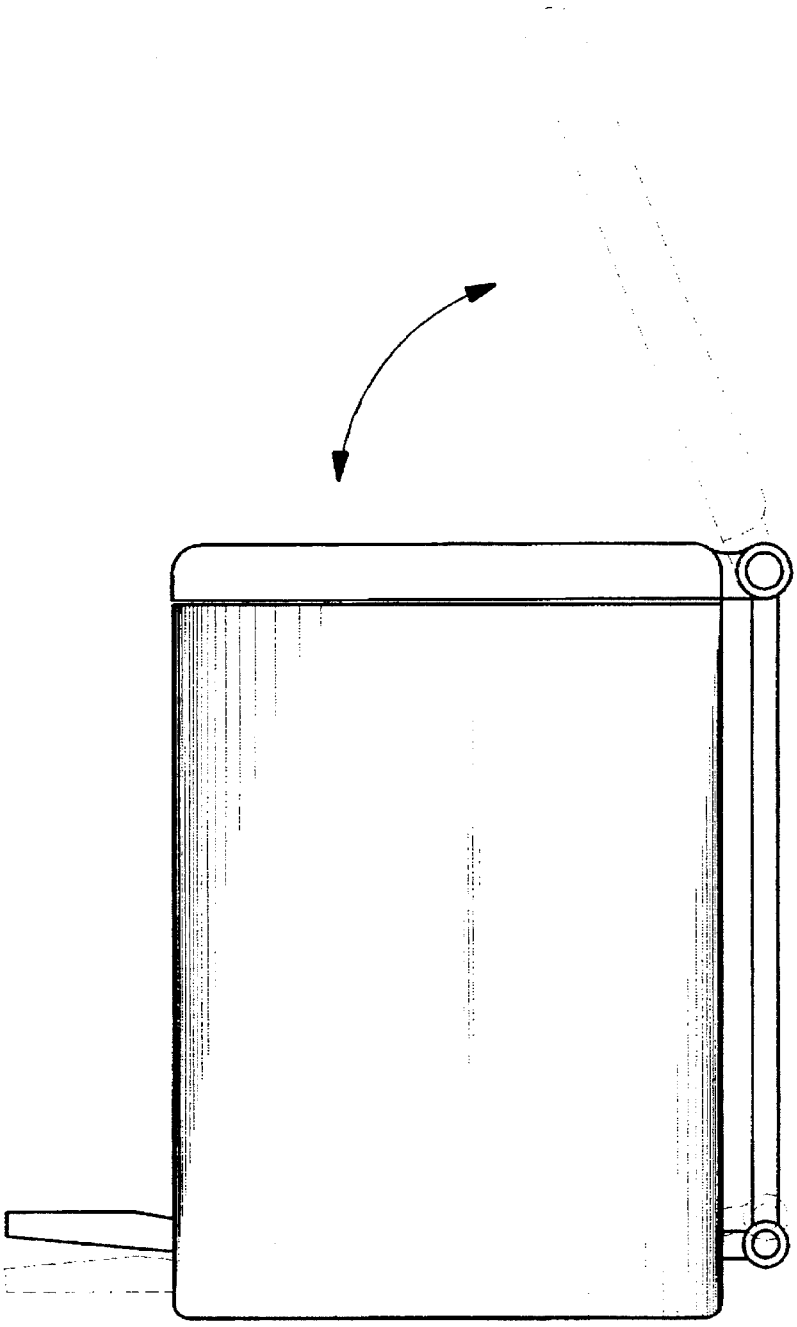
FIG. 1 PRIOR ART
FIG. 1 is a perspective view of the motion of a conventional foot trash can.
Figure 2:
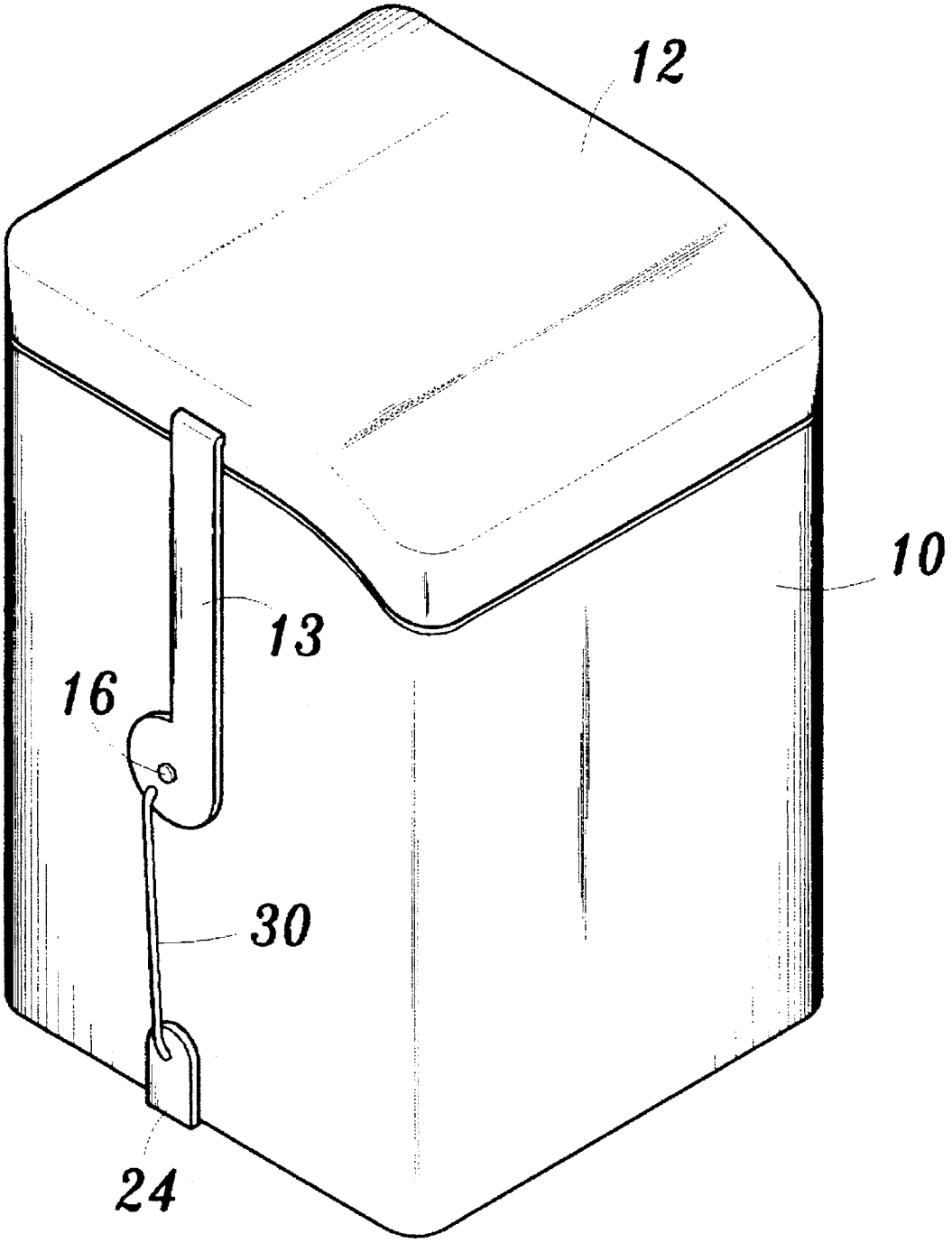
FIG. 2 is a perspective view of the first embodiment of the present invention.
Figure 3:
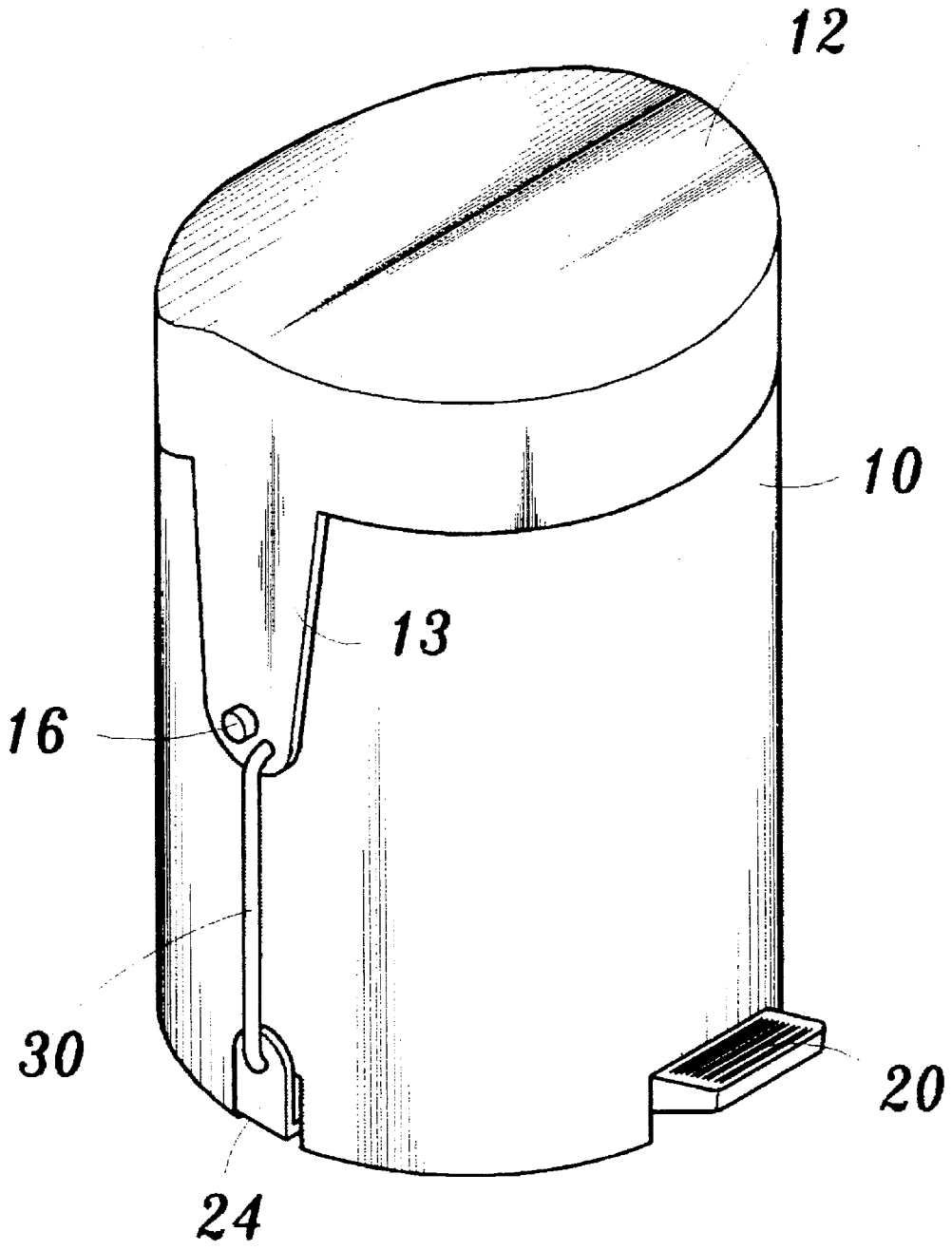
FIG. 3 is a perspective view of the second embodiment of the present invention.
Figure 4:
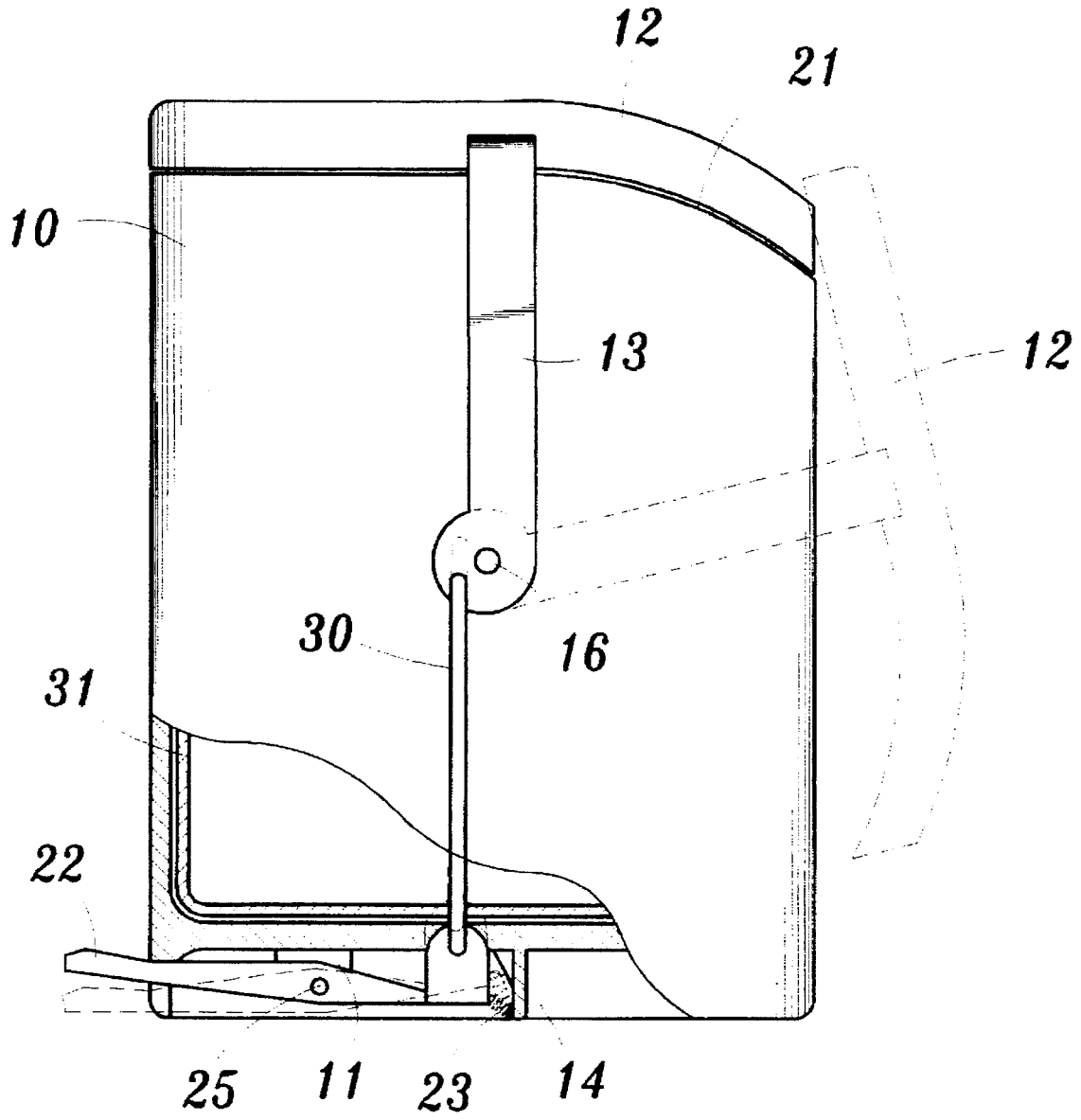
FIG. 4 is a sectional side view of the part of the present invention.
Figure 5:
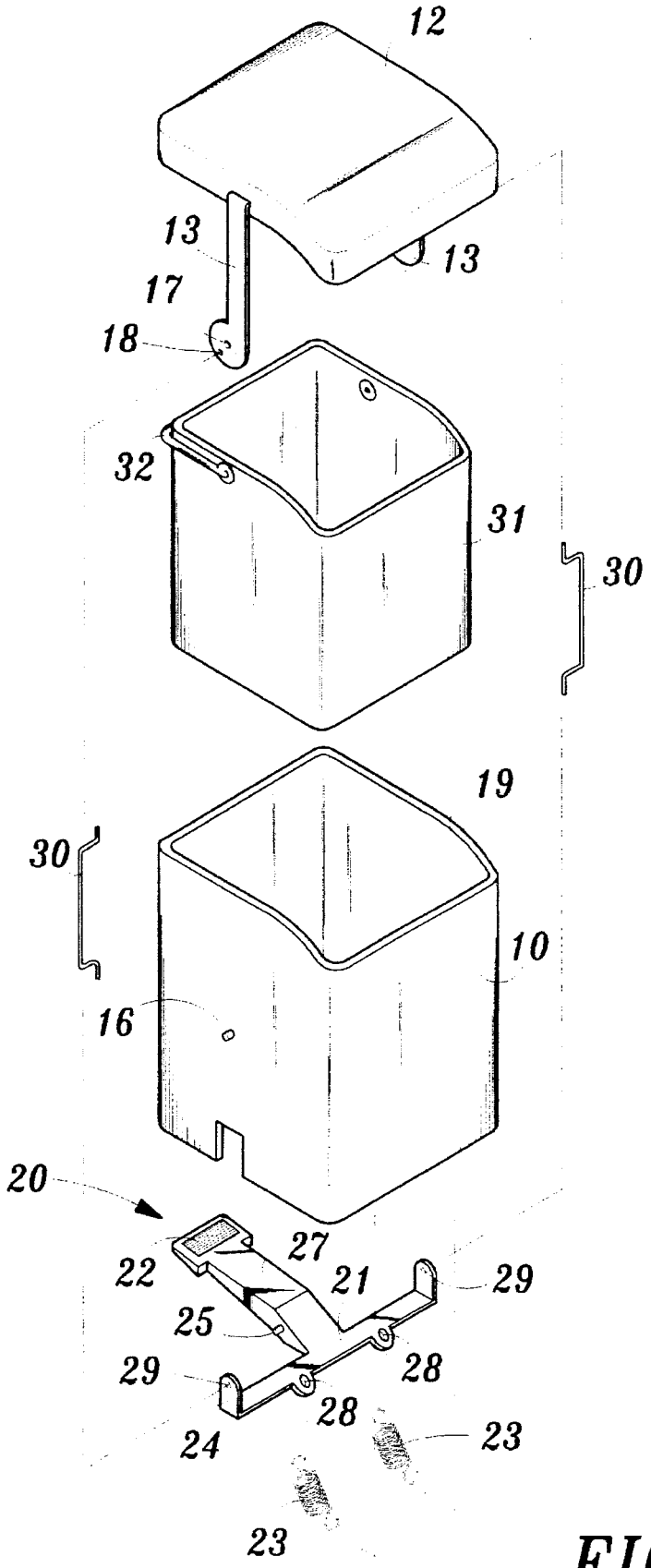
FIG. 5 is a pictorial explosive view of the present invention.
Figure 6:
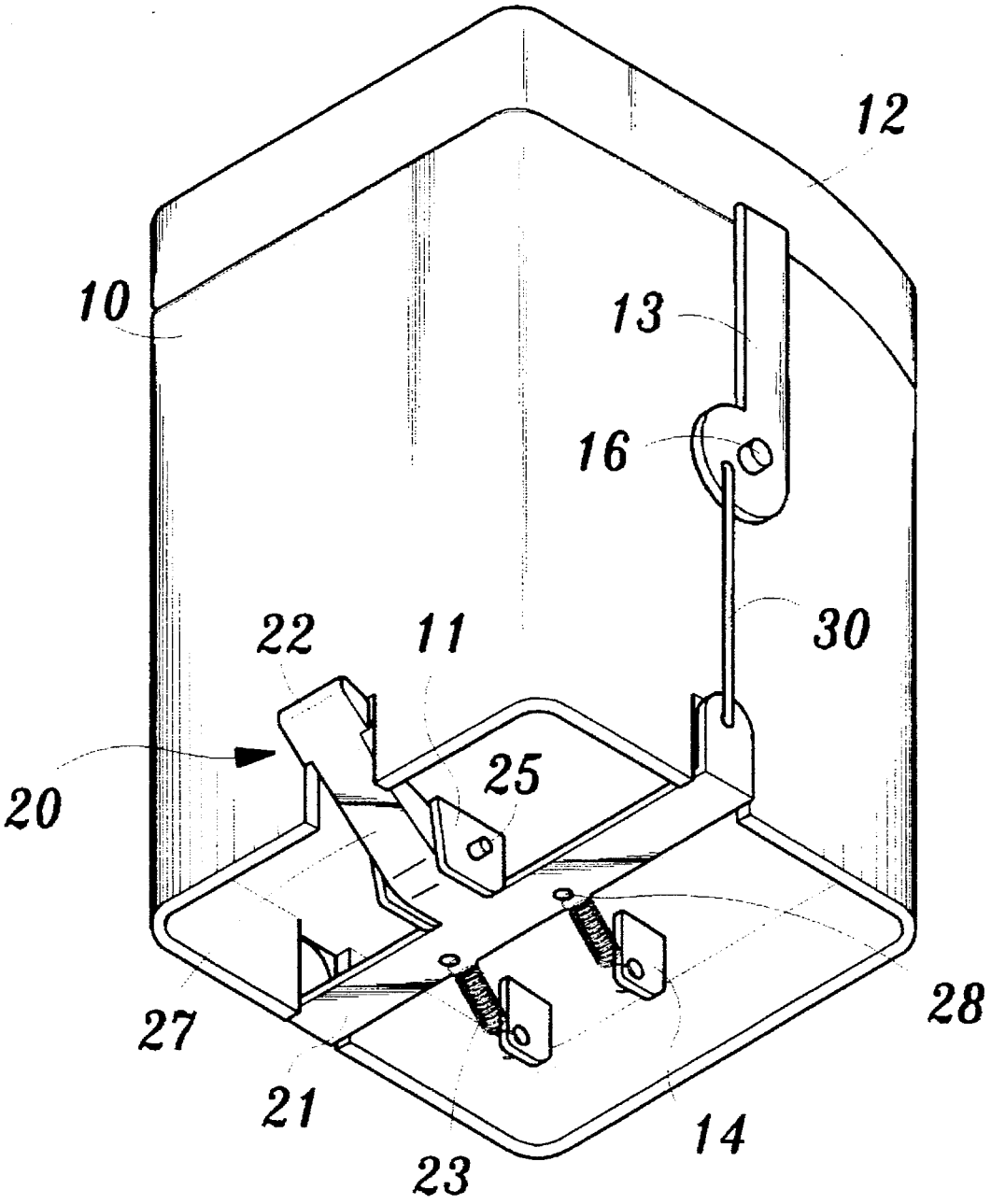
FIG. 6 is a pictorial bottom view of the present invention.

Now referring to FIGS. 2–3, the present invention, a new structure of a foot trash can, is comprised of a can main body 10, an inner can 31, a can cover 12, two coupling levers 30, a pedal lever 20, and two tension springs 23, the can main body can be made in various kinds of shape so as to increase the variety of the invention, such as the square shape in FIG. 2 and the round shape in FIG. 3, indicating that the present invention is not affected by the shape of the can main body and that it can have its exterior variety and alternatives. To fit the sliding-down arc flange 19 of the main body 10, the rear portion of the cover 12 is also made into a particular sliding-down arc flange 15; at the two sides of the cover 12, there are two rod supports 13 extending downward, each support 13 has a shaft hole 17 at its lower end and a lever hole 18 at its upper end, the shaft hole 17 of the support 13 is connected with the shaft 16 extended from the both sides of the can main body 10 so as to make the cover 12 go round and use the shaft 16 as the center of its circumferential movement, a lever 30 which connects to the lever hole 18 of the lower end of the supper 13 at its left side is pushed by the pedal lever 20, the "T" shaped pedal lever 20 has two arms 21, the end 24 of the arm 21 is bent upright and has a lever hole 29 to connect with the lower end of the coupling lever 30, a shaft 25 is disposed at the side of the pedal lever main body 27 which has two spring holes 28 at its right end and has a pedal plate 22 at its left end, the pedal plate 22 extends from the bottom of the can main body 10 to the front of the can main body 10 which has two shaft fixing pieces 11, and the shaft 25 is pivoted to the fixing piece 11, when a foot pushes down the pedal plate 22, the pedal lever 20, using the shaft 25 as its center, will push up the coupling lever 30 and move the support 13 of the cover 12, using the shaft 16 as its rotary center to let the cover 12 slide down along the arc flange 19 of the can main body backward to the back side of the can main body 10 and eventually open the cover 12; the cover 12 will be pulled in an arc downward to make a circumferential movement so as to open the trash can 10; as shown in FIG. 4, the cover 12 slides downward along the particularly designed flange 15 of the opening of the can main body 10, so that the cover 12 can easily slide to the back side of the can main body 10 and make the can completely open, this kind of design is to improve the disadvantages of the conventional foot trash can; the object of this kind of design is to improve the disadvantages of a conventional type of foot trash can because its cover is designed to lift up vertically right above the opening of the can and so the cover will prevent the users throwing trash into the can from behind the cover; otherwise, the users have to walk around or stand up to throw the trash and this may cause inconvenience; besides, the bad odor will spread out of the trash can when the cover is lifted up; those disadvantages will be overcomed by the present invention because the cover of the present invention is designed to slide in an arc downward; after the cover 11 of the present invention is opened, it will return to its normal closing position by means of the tension of the spring 23 and thus prevent the bad odor spreading out of the trash can; an inner can 31 similar to and smaller than the can main body is disposed in the can main body 10, the user can easily take the inner can 31 out of the can main body 10 by lifting the handle 32 up and then dump the trash. Now referring to FIGS. 5–6, the "T" shaped pedal lever 20 uses two tension spring 23 as its tension source, one end of the spring 23 is hung on the spring hole 28 of the pedal lever 20 and the other end is hung on the spring hole of the spring fixing piece 14 on the bottom of the can main body 10, and the lever 20 has a pair of shaft 25, each of which is pivoted to the shaft fixing piece 11 at the bottom of the can main body 10 and which is used as a supporting point for the principle of lever so that when pedal lever 20 is pushed down by a foot, the other end of the lever 20 will push the coupling lever 30 to move upward and at the same time the tension spring 23 will be pulled to produce a brake force, when the foot releases the pedal lever 20, the pedal lever 20 will be pulled by the returning force of the spring 23 back to return to its normal position, and so the coupling lever 30 will pull the cover 12 back to its normal closing position to cover the opening of the can main body 10 and prevent the bad odor from the trash can. The present invention is really a quite easy and convenient equipment.

Many changes and modifications in the above described embodiment of the invention can, of course, be carried without departing from the scope thereof. Accordingly, to promote the progress in science and the useful arts, the invention is disclosed and is intended to be limited only by the scope of the appended claims.

What is claimed is:

1. A foot-operated trash can comprising:

a can main body having a bottom plate, a rear portion of an opening of said can main body including a curved slope flange, a shaft is disposed at a center of two sides of said can main body, and two spring fixing pieces and two shaft fixing pieces are secured on a bottom of said can main body;

an inner can constructed to fit into the interior of said main can body, said inner can includes a handle to facilitate easy removal from said main can body;

a cover constructed to conform to the shape of said opening of said main can body, a back portion of said cover including a curved slope flange, the cover further having two rod supports extending downward, a distal end of said rod supports including a coupling hole at a front portion thereof and a shaft hole at a center portion thereof, the shaft hole of said rod support is connected to said shaft of said main can body so as to rotate said cover using said shaft as an axis;

a pair of coupling levers, a first end of each said coupling lever is received in one of said coupling lever holes on said rod supports of said cover, a second end of each coupling lever extends nearly to the bottom of said main can body;

a pedal lever comprising a main body and two arms, a free end of each said arm is bent upright and has a lever hole therein to receive the second ends of said coupling levers, said arms of said pedal lever each further include a spring hole, said main body includes a pedal plate at a free end, a shaft extending outward on each side of said main body of said pedal lever near the point where the main body joins with the arms, said shafts being pivotally received in said shaft fixing pieces secured on the bottom of said main can body; such that when a user pushes a foot downward on said pedal plate, said pedal lever, using said shafts on said main body of said pedal lever as an axis of rotation, pushes up said coupling lever and moves said cover downward along an arc flange of said main can body toward a back side of said main can body so that the cover is opened, said arms of said pedal lever receive a first end of each of a pair of tension springs, second ends of said tension springs are received in said spring fixing pieces on the bottom of said main can body, such that when said pedal plate is pushed down by the user's foot, said tension springs provide an opposing force, thereby urging said pedal lever to its original position when the user releases the pedal plate, and said coupling lever pulls said cover back to a closed position over said opening of said can main body.

* * * * *